US005567130A

United States Patent [19]

Kvinge et al.

[11] Patent Number: 5,567,130

[45] Date of Patent: Oct. 22, 1996

[54] REINFORCED COVER CONFIGURATION FOR A DIAPHRAGM PUMP

[75] Inventors: Daniel J. Kvinge, Canton, Mich.; Harold D. Johnson, Buffalo, Minn.

[73] Assignee: Graco Inc., Minneapolis, Minn.

[21] Appl. No.: 337,328

[22] Filed: Nov. 9, 1994

[51] Int. Cl.[6] ..... F04B 53/16

[52] U.S. Cl. ..... 417/393; 417/395; 92/169.2

[58] Field of Search ..... 417/389, 393, 417/395, 413.1, 423.14, DIG. 1; 92/98 R, 169.1, 169.2; 415/182

[56] References Cited

U.S. PATENT DOCUMENTS

| | | | |
|---|---|---|---|
| 2,625,886 | 1/1953 | Browne | 417/393 |
| 3,782,863 | 1/1974 | Rupp | 417/393 |
| 4,682,937 | 7/1987 | Credle, Jr. | 417/393 |
| 4,817,503 | 4/1989 | Yamada | 92/98 R |
| 5,174,731 | 12/1992 | Korver | 417/393 |

*Primary Examiner*—Timothy S. Thorpe
*Assistant Examiner*—Roland G. McAndrews, Jr.
*Attorney, Agent, or Firm*—Douglas B. Farrow

[57] ABSTRACT

A diaphragm pump housing is designed for molding out of plastic and utilizes a ribbing design which allows a high degree of strength while using a minimal amount of material and/or material having lesser strength. The rib design has an outer circumferencial rib about the periphery of the pump housing and a plurality of radial extending ribs extend outwardly from the center of the housing to the outer circumferencial rib. Fastener apertures are used to tie together the parts of the pump and the fastener apertures are located between the radial extending ribs in the outer circumferencial rib. An intermediate circumferencial rib is provided adjacent the outer circumferencial rib. The height of the ribs increases from the center of the housing outwardly to the outer circumference. The radial and the circumferencial ribs are the same height at locations where they intersect. This high strength design also allows use of one piece inlet and outlet manifolds without undue flexing or leakage.

8 Claims, 5 Drawing Sheets

REINFORCED COVER CONFIGURATION FOR A DIAPHRAGM PUMP

BACKGROUND OF THE INVENTION

Air operated double diaphragm pumps have been known and used for many years for a variety of applications. In recent years plastic molded versions of such pumps have become increasingly popular due to the increased chemical compatibility offered by the various plastic materials available. Such plastic pumps have been mainly popular in the smaller sizes as larger size plastic pumps typically have been required to be manufactured out of a metal in order to achieve sufficient strength for those larger sizes.

While various rib designs have been utilized to increase the strength of the fluid housings, such housings still tended to have relatively low burst strengths or require the use of stronger filled materials in order to achieve sufficient strength.

SUMMARY OF THE INVENTION

It is therefore an object of this invention to provide a design capable of being molded out of plastic which achieves sufficient strength to provide safe operation at high pressures and which can be easily and inexpensively molded from readily available and inexpensive materials.

It is also an object of this invention to provide high strength at both ambient and high temperatures and to reduce possible leakage paths. By designing a strong fluid cover, one-piece inlet and outlet manifolds may be utilized.

In the preferred embodiment, the fluid cover is designed for molding from a material such as polypropylene. A plurality of ribs extend upwardly from the outer surface of the dome of the cover and there are generally three circumferencial ribs and a plurality of radial extending ribs which form the ribbing system which provides the improvement of the instant invention.

In particular, an outer circumferencial rib extends above the periphery of the device. A plurality of radially extending ribs extend outwardly from the center of the fluid cover and intersect the outer circumferencial ribs. A plurality of fastener openings are provided in the cover to allow it to be bolted or otherwise fastened to the center section of the pump. The fastener apertures are located in the outer circumferencial rib and between the radially extending ribs. There are fewer fasteners than radial ribs as the design does not require a large number of fasteners. An intermediate circumferencial rib is located closely adjacent the outer circumferencial rib while an inner circumferencial rib is located adjacent the center of the dome.

A one-piece manifold is utilized which greatly decreases the number of fluid paths which could possibly leak.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
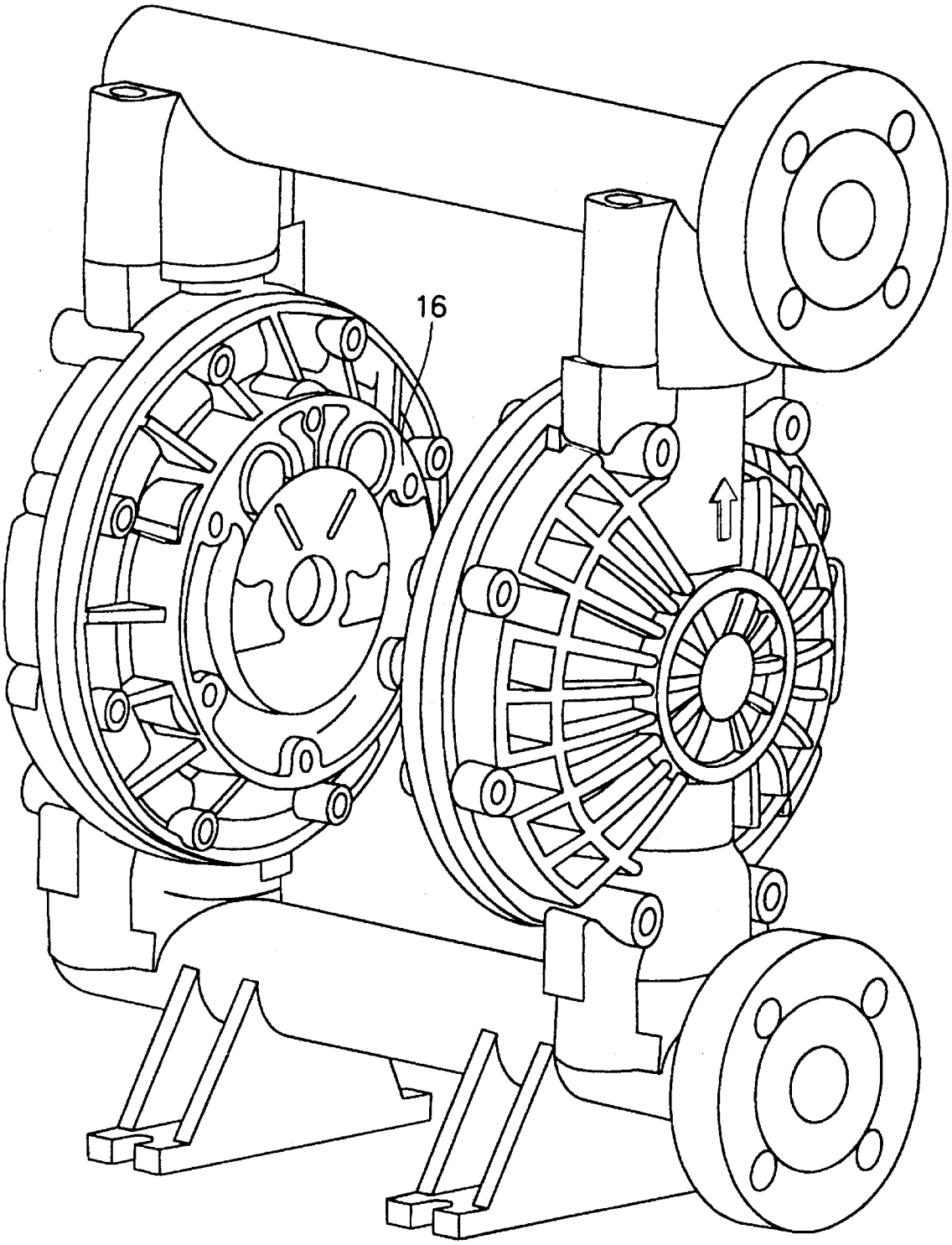
FIG. 1 is a perspective view of the pump utilizing the fluid cover.
Figure 2:
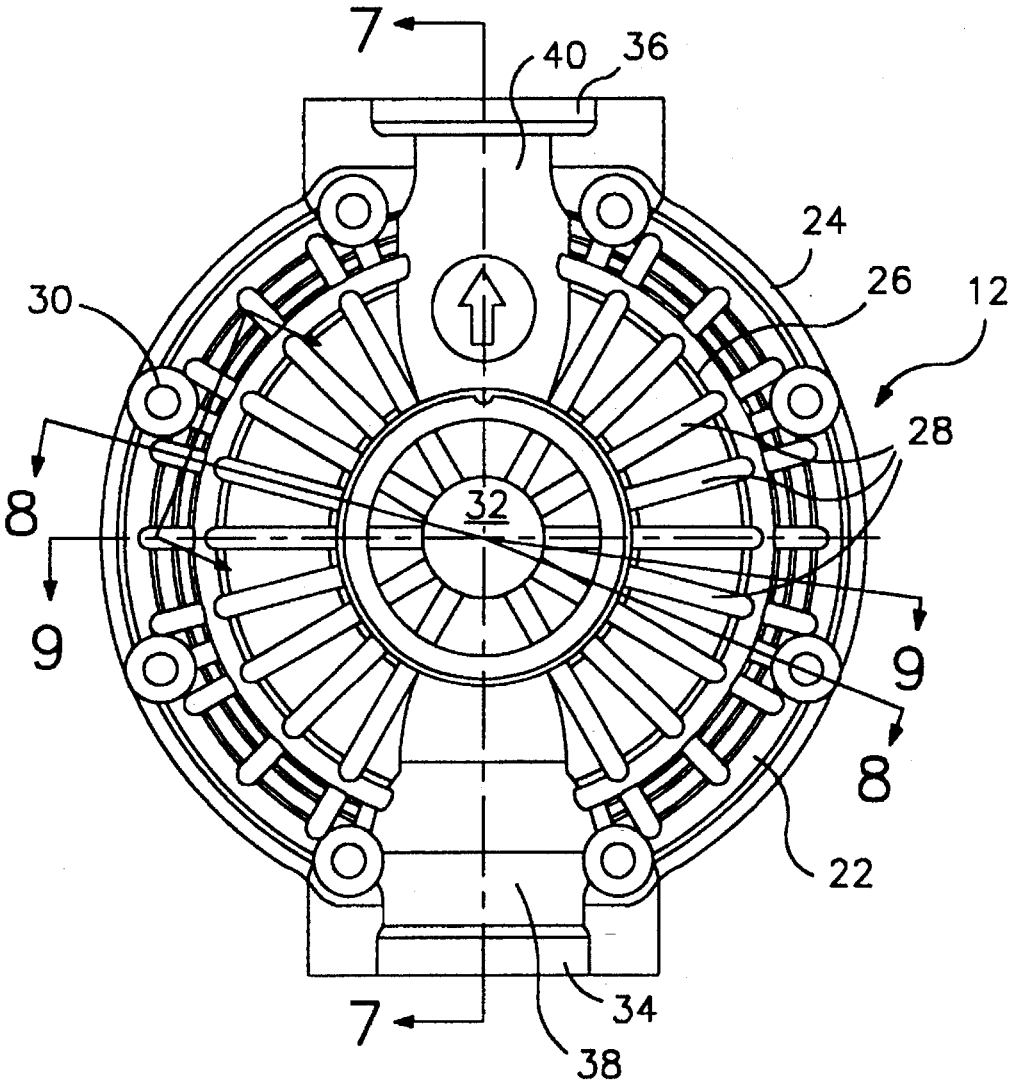
FIG. 2 is a view showing the main outer surface of the fluid cover.
Figure 4:
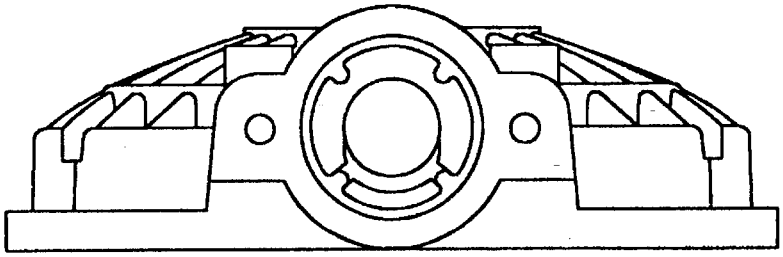
FIG. 4 is a top view of the fluid cover.
Figure 3:
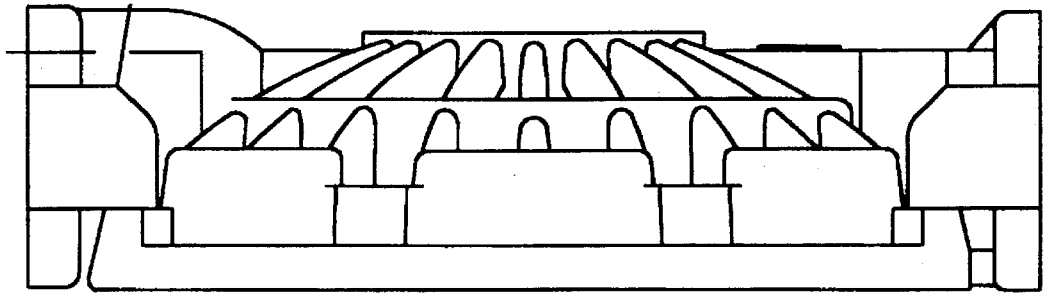
FIG. 3 is a side view of the fluid cover.
Figure 7:
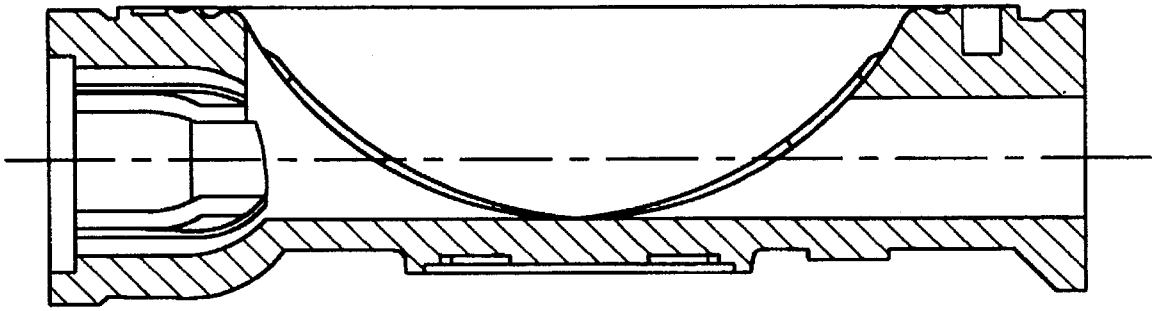
FIG. 7 is a sectional view taken along line 7—7 of FIG. 2.
Figure 5:
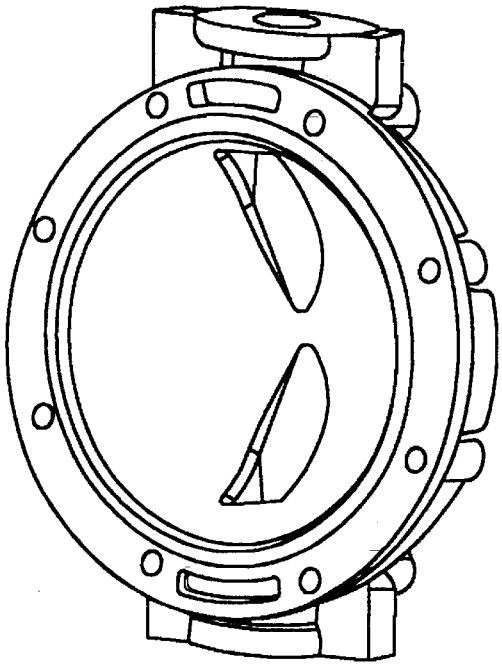
FIG. 5 is a perspective view of the inner side of the fluid cover.
Figure 6:
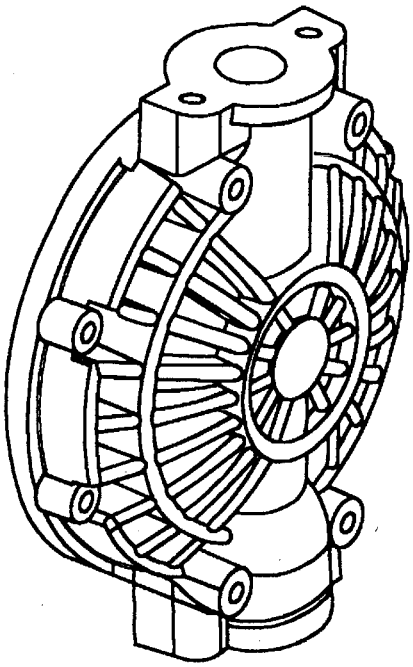
FIG. 6 is a perspective view of the fluid cover.
Figure 8:
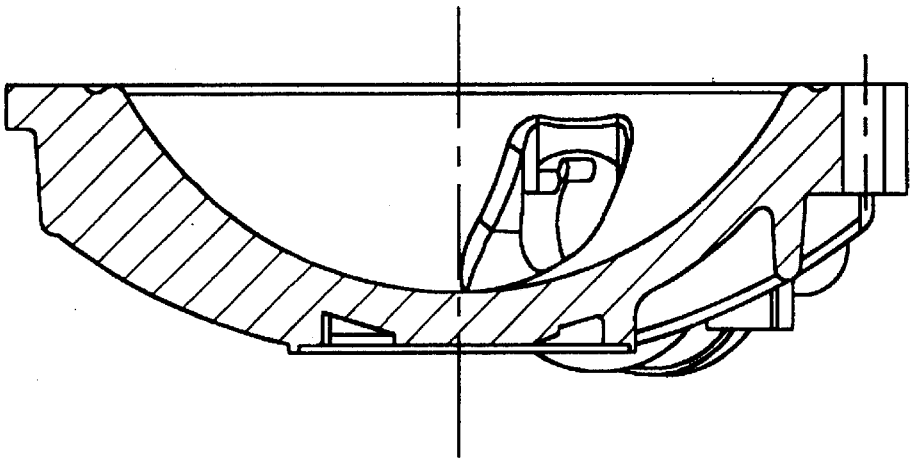
FIG. 8 is a sectional view taken along line 8—8 of FIG. 2.

The air-operated double diaphragm pump of the instant invention, generally designated (10) is best shown and seen in FIG. 1 and is comprised generally of two fluid housings (12) which have attached thereto an inlet manifold (14) and an outlet manifold (16). Air housings (16) are attached to each fluid housing and are also molded of one piece. A diaphragm (not shown) is sandwiched between each air housing (18) and fluid housing (12). An air valve section (not shown) is located between the air housings (18).

Figure 9:
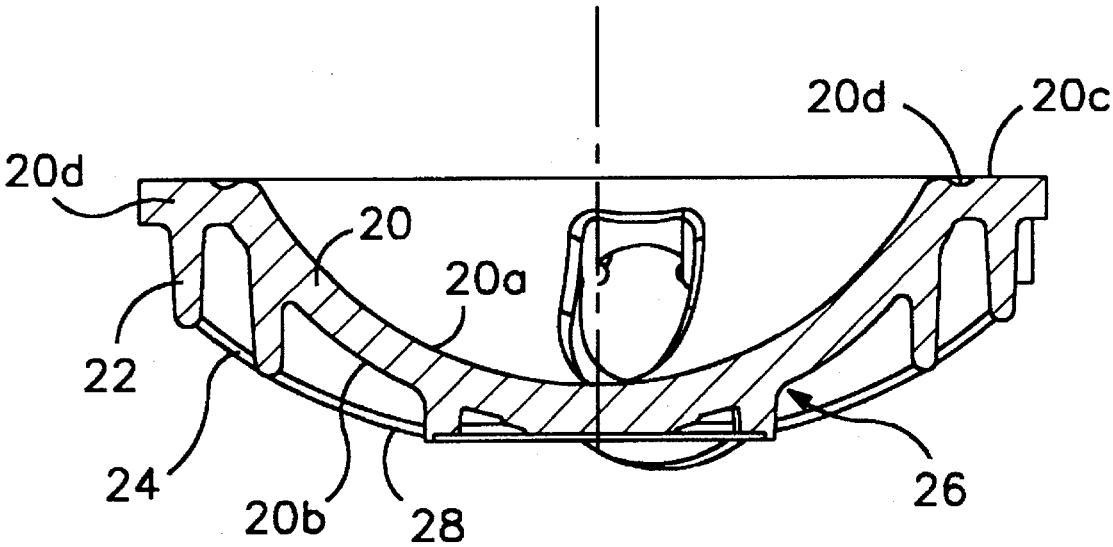
FIG. 9 is a sectional view taken along line 9—9 of FIG. 2.

Turning more specifically to the fluid housing (12) of the instant invention, the dome (20) is best seen in FIG. 9 and has a thickness generally uniform of approximately 0.4 inches. The diameter of the fluid chamber in the dome is approximately 5.88 inches. Dome (20) is comprised of inner surface (20*a*) and outer surface (20*b*). Dome (20) also has a sealing surface (20*c*) having an annular recess (20*d*) for receiving and retaining the diaphragm edge. Sealing surface (20*c*) is located on flange (20*d*) which has extending upwardly therefrom an outer circumferencial rib (22).

Located slightly inwardly of outer circumferencial rib (22) is intermediate circumferencial rib (24). An inner circumferencial rib (26) is located adjacent the center (28) of dome (20). Outer circumferencial rib extends upwardly from flange (20) approximately 0.8 inch. The intermediate circumferencial rib extends upwardly from outer surface (20*b*) approximately 1.07 inches on its outer side and approximately 0.72 inches on its inner side. Inner circumferencial rib (26) extends upwardly approximately 0.46 inches on its outer side and approximately 0.23 inches on its inner side. As can be seen more specifically in FIG. 9, radially extending ribs (28) follow the contour formed by the top of the respective ribs (22, 24, and 26) to form a smooth transition between.

A plurality of fastener holes (30) are located on the outer circumferencial rib (22) and are used to fasten pump (10) together by insertion of bolts or other conventional fastening mechanisms. A center boss (32) serves to terminate radially extending ribs (28). Inlet (34) and outlet (36) flanges are molded into cover (12) and serves as the termination of inlet passage (38) and outlet passage (40) respectively.

The dimensions and figures referred to as being the preferred embodiment are designed for use in a 1 inch pump that is molded of polypropylene and provides a burst strength of approximately 500 psi. This design is of course suited for use in pumps of other sizes as well.

It is contemplated that various changes and modifications may be made to the pump without departing from the spirit and scope of the invention as defined by the following claims.

What is claimed is:

1. A diaphragm pump fluid cover having a domed fluid chamber surface, said diaphragm pump fluid cover comprising:

a generally uniform thickness;

an outer circumferencial rib;

a plurality of radially extending ribs; and a plurality of fastener apertures located in said outer circumferencial rib and intermediate all of said radially extending ribs, the number of said radially extending ribs being greater than the number of said fastener apertures.

2. The diaphragm pump fluid cover of claim 1 further comprising an intermediate circumferencial rib located radially inwardly from and closely adjacent to said outer circumferencial rib.

3. The diaphragm pump fluid cover of claim 1 further comprising an inner circumferencial rib located adjacent the center of said cover.

4. The diaphragm pump fluid cover of claim 3 wherein said outer circumferencial rib extends farther outwardly from said thickness than said inner circumferencial rib and said radially extending ribs taper in thickness from said outer circumferencial rib to said inner circumferencial rib.

5. A diaphragm pump comprising:

first and second fluid covers, each said fluid cover comprising:

a generally uniform thickness;

an outer circumferencial rib;

a plurality of radially extending ribs; and a plurality of fastener apertures located in said outer circumferencial rib and intermediate all of said radially extending ribs, the number of said radially extending ribs being greater than the number of said fastener apertures;

a center section attached to said fluid covers and comprising air chambers;

a one piece intake manifold attached to said fluid covers; and a one piece outlet manifold attached to said fluid covers.

6. The diaphragm pump fluid cover of claim 5 further comprising an intermediate circumferencial rib located radially inwardly from and closely adjacent to said outer circumferencial rib.

7. The diaphragm pump fluid cover of claim 5 further comprising an inner circumferencial rib located adjacent the center of said cover.

8. The diaphragm pump fluid cover of claim 7 wherein said outer circumferencial rib extends farther outwardly from said thickness than said inner circumferencial rib and said radially extending ribs taper in thickness from said outer circumferencial rib to said inner circumferencial rib.

* * * * *